US011542810B2

(12) United States Patent
Hallundbæk et al.

(10) Patent No.: US 11,542,810 B2
(45) Date of Patent: Jan. 3, 2023

(54) DOWNHOLE TOOL FOR DETERMINING LATERALS

(71) Applicant: WELLTEC A/S, Allerød (DK)

(72) Inventors: Jørgen Hallundbæk, Græsted (DK); Jimmy Kjærsgaard-Rasmussen, Bikerød (DK)

(73) Assignee: Welltec A/S, Allerød (DK)

( * ) Notice: Subject to any disclaimer, the term of this patent is extended or adjusted under 35 U.S.C. 154(b) by 49 days.

(21) Appl. No.: 16/872,737

(22) Filed: May 12, 2020

(65) Prior Publication Data

US 2020/0270983 A1 Aug. 27, 2020

Related U.S. Application Data

(63) Continuation of application No. 14/130,224, filed as application No. PCT/EP2012/062419 on Jun. 27, 2012, now abandoned.

(30) Foreign Application Priority Data

Jun. 30, 2011 (EP) ..... 11172151

(51) Int. Cl.
*E21B 47/09* (2012.01)
*E21B 4/18* (2006.01)
(Continued)

(52) U.S. Cl.
CPC ..... *E21B 47/09* (2013.01); *E21B 4/18* (2013.01); *E21B 41/0035* (2013.01); *E21B 47/085* (2020.05); *E21B 47/092* (2020.05)

(58) Field of Classification Search
CPC ..... E21B 47/085; E21B 47/09; E21B 47/092; E21B 4/18; E21B 41/0035
See application file for complete search history.

(56) References Cited

U.S. PATENT DOCUMENTS 4,022,055 A * 5/1977 Flournoy ..... G01B 17/02 73/627
4,587,641 A * 5/1986 DiFoggio ..... G01V 11/005 181/105
(Continued)

FOREIGN PATENT DOCUMENTS

CN 1250133 4/2000
CN 2685569 3/2005
(Continued)

OTHER PUBLICATIONS

Office Action dated Apr. 7, 2017 issued in Russian Patent Application No. 2014102495/03(003800) with English translation (24 pages).
(Continued)

*Primary Examiner* — John Fitzgerald
(74) *Attorney, Agent, or Firm* — Nixon & Vanderhye, P.C.

(57) ABSTRACT

A downhole tool for determining laterals in a borehole wall or a borehole casing, comprising a tool housing extending along a longitudinal axis and having a circumference perpendicular to the longitudinal axis and a plurality of sonic transceivers. Each sonic transceiver transmitting sonic signals from the housing and receiving sonic signals reflected from the borehole wall or borehole casing in a predefined angular segment. The sonic transceivers are arranged along the circumference of the tool housing having a mutual distance and are capable of transmitting sonic signals radially away from the tool housing in an entire central angle of 360 degrees towards the borehole wall or borehole casing. During a pulse time, one sonic transceiver transmits a sonic signal in the predefined angular segment of that sonic transmitter, and one sonic transceiver, during a subsequent echo time, receives a reflected sonic signal from the borehole wall or borehole casing.

12 Claims, 3 Drawing Sheets

(51) Int. Cl.

| | |
|---|---|
| ***E21B 41/00*** | (2006.01) |
| ***E21B 47/085*** | (2012.01) |
| ***E21B 47/092*** | (2012.01) |

(56) References Cited

U.S. PATENT DOCUMENTS

| | | | | |
|---|---|---|---|---|
| 4,814,768 | A * | 3/1989 | Chang | G01S 13/0209 324/333 |
| 4,867,264 | A | 9/1989 | Siegfried | |
| 4,928,269 | A * | 5/1990 | Kimball | G01V 1/306 181/105 |
| 5,164,548 | A | 11/1992 | Angehrn | |
| 5,195,588 | A | 3/1993 | Dave | |
| 5,678,643 | A | 10/1997 | Robbins et al. | |
| 5,996,711 | A * | 12/1999 | Ohmer | E21B 7/061 166/255.2 |
| 6,041,860 | A * | 3/2000 | Nazzal | E21B 43/114 166/250.01 |
| 6,527,067 | B1 * | 3/2003 | Ravensbergen | E21B 41/0035 175/73 |
| 7,757,782 | B2 * | 7/2010 | Tashiro | E21B 23/12 175/45 |
| 8,117,907 | B2 * | 2/2012 | Han | E21B 47/085 73/152.58 |
| 10,344,589 | B1 * | 7/2019 | Arsalan | G01V 3/28 |
| 10,739,318 | B2 * | 8/2020 | Huang | E21B 33/06 |
| 10,876,377 | B2 * | 12/2020 | Quero | E21B 47/022 |
| 2001/0042621 | A1 * | 11/2001 | Leising | E21B 41/0035 166/50 |
| 2003/0235114 | A1 | 12/2003 | Pabon | |
| 2005/0039915 | A1 * | 2/2005 | Murray | E21B 41/0035 166/117.6 |
| 2005/0259512 | A1 * | 11/2005 | Mandal | E21B 47/085 367/10 |
| 2006/0032792 | A1 | 2/2006 | Warren | |
| 2006/0042792 | A1 * | 3/2006 | Connell | E21B 23/12 166/255.3 |
| 2008/0135293 | A1 * | 6/2008 | Tashiro | E21B 23/12 175/45 |
| 2008/0156479 | A1 | 7/2008 | Cassidy | |
| 2009/0166035 | A1 | 7/2009 | Almaguer | |
| 2010/0226206 | A1 | 9/2010 | Al-Khamis | |
| 2011/0080806 | A1 | 4/2011 | Normann | |
| 2011/0278070 | A1 * | 11/2011 | Hopkins | E21B 4/02 175/78 |
| 2013/0169279 | A1 | 7/2013 | Morys | |
| 2014/0014368 | A1 * | 1/2014 | Hallundbæk | E21B 23/04 166/381 |
| 2016/0170063 | A1 * | 6/2016 | Leggett | G10K 11/346 367/7 |
| 2016/0216393 | A1 * | 7/2016 | Zhou | E21B 47/002 |
| 2018/0112524 | A1 * | 4/2018 | Huang | E21B 47/107 |
| 2018/0306750 | A1 * | 10/2018 | Huang | E21B 33/06 |
| 2020/0003026 | A1 * | 1/2020 | Quero | E21B 41/0035 |
| 2021/0247538 | A1 * | 8/2021 | Guedes | E21B 47/006 |

FOREIGN PATENT DOCUMENTS

| | | | |
|---|---|---|---|
| CN | 101761330 | | 6/2010 |
| EP | 2317070 | A1 | 5/2011 |
| WO | 98/02638 | A1 | 1/1998 |
| WO | 98/12418 | A2 | 3/1998 |
| WO | 2008/068561 | A1 | 6/2008 |

OTHER PUBLICATIONS

Office Action dated Sep. 6, 2016 issued in Russian Application No. 20143102495/03(003800) with English translation (18 pages).

International Search Report for International Application No. PCT/EP2012/062419, dated Nov. 5, 2012 (three pages).

Written Opinion for International Application No. PCT/EP2012/062419, dated Nov. 5, 2012 (seven pages).

International Preliminary Report on Patentability issued in International Application No. PCT/EP2012/062419, dated Jan. 7, 2014 (eight pages).

Office Action dated Dec. 1, 2015 issued in Chinese Application No. 2012800324565 with English Translation (19 pages).

R. Morin 1, T. Williams, S. Henrys, T. Crosby, D. Hansaraj & The Andrill-Mis Science Team, "Downhole Measurements in the AND-1B Borehole", Andrill McMurdo Ice Shelf Project, Antarctica, Date: 2007, Publisher: Terra Antarctica, 14(3), pp. 167-174.

* cited by examiner

DOWNHOLE TOOL FOR DETERMINING LATERALS

This application is a Continuation of application Ser. No. 14/130,224 filed Mar. 24, 2014, which is the U.S. national phase of International Application No. PCT/EP2012/062419, filed 27 Jun. 2012, which designated the U.S. and claims priority to EP Application No. 11172151.0, filed 30 Jun. 2011, the entire contents of each of which are hereby incorporated by reference.

FIELD OF THE INVENTION

The present invention relates to a downhole tool for determining laterals in a borehole wall or a borehole casing, comprising a tool housing extending along a longitudinal axis and having a circumference perpendicular to the longitudinal axis and adapted to be lowered into a well, and a plurality of sonic transceivers, each sonic transceiver transmitting sonic signals from the housing and receiving sonic signals reflected from the borehole wall or borehole casing in a predefined angular segment. Furthermore, the invention relates to a downhole system and a method of determining a position of a lateral.

BACKGROUND ART

Wellbores with multiple forked branches and laterals reduce overall costs, increase production and improve reservoir drainage. These types of wells can increase recoverable reserves, make reservoirs easier to manage, and are growing in popularity. However, constructing complicated well profiles is challenging and risky. The latest applications and system developments are convincing operators that multilateral advantages outweigh the disadvantages and therefore the need for navigating tools in multilateral wells are currently increasing. Because of the capability to more thoroughly drain reservoirs vertically and horizontally, recoverable reserves per well and per field are increased considerably while both capital and operating costs per well and per field are minimised. In fact, the cost of achieving the same degree of drainage with conventional wells would be prohibitive in most cases, especially in the case of e.g. deepwater subsea developments. Multilateral wells allow costs to be amortised over several reservoir penetrations and have in some cases eliminated the need for infill drilling. In heterogeneous reservoirs with layers, compartments or randomly oriented natural fractures, more pockets of oil and gas can be exploited and an increased number of fractures can be intersected by drilling multilateral wells. Visual representations using light, lasers, infrared light etc. have the disadvantage of being limited during drilling due to mud flow or during production due to oil-bearing liquids. The use of sonic measurements for positioning and measurement of fluid velocities etc. are therefore increasingly being developed for these purposes. However, determination of laterals is problematic since sonic measurements typically take advantage of repeating pattern measurements with knowledge of Doppler effects, which cannot be applied to the determination of laterals.

SUMMARY OF THE INVENTION

It is an object of the present invention to wholly or partly overcome the above disadvantages and drawbacks of the prior art. More specifically, it is an object to provide an improved downhole tool capable of determining downhole laterals in multilateral wells.

The above objects, together with numerous other objects, advantages, and features, which will become evident from the below description, are accomplished by a solution in accordance with the present invention by a downhole tool for determining laterals in a borehole wall or a borehole casing, comprising:

- a tool housing extending along a longitudinal axis and having a circumference perpendicular to the longitudinal axis and adapted to be lowered into a well, and
- a plurality of sonic transceivers, each sonic transceiver transmitting sonic signals from the housing and receiving sonic signals reflected from the borehole wall or borehole casing in a predefined angular segment, wherein the plurality of sonic transceivers are arranged along the circumference of the tool housing having a mutual distance and are capable of transmitting sonic signals radially away from the tool housing in an entire central angle of 360 degrees towards the borehole wall or borehole casing and wherein, during use, one sonic transceiver, during a pulse time, transmits a sonic signal in the predefined angular segment of that sonic transmitter, and wherein one sonic transceiver, during a subsequent echo time, receives a reflected sonic signal from the borehole wall or borehole casing, and wherein an absence of the received reflected sonic signal, during the subsequent echo time, indicates a lateral.

The downhole tool according to the present invention may further comprise a magnetic profiler for measuring a magnetic profile of the borehole casing Said magnetic profiler may be capable of applying a magnetic field and measuring a change in the magnetic field.

Further, the change in the magnetic field may be measured as a function of an interaction between the borehole casing and the magnetic field.

In one embodiment of the invention, the sonic transceivers may be arranged equidistantly along the circumference of the tool housing, having a fixed mutual distance.

Further, the sonic transceivers may be arranged along the circumference of the tool housing in a regular pattern.

Said sonic transceivers may be arranged along the circumference of the tool housing in a regular pattern, such as a zigzag pattern.

In another embodiment, more than one transceiver may be receiving during the echo time.

Also, more than one transceiver may be transmitting during the pulse time.

Furthermore, the downhole tool may comprise at least four sonic transceivers, each transceiver being capable of transmitting sonic signals covering at least one forth of the entire central angle such as at least eight sonic transceivers, each transceiver being capable of transmitting sonic signals covering at least one eighth of the entire central angle.

Moreover, the downhole tool may comprise an array of sonic transceivers capable of transmitting sonic signals covering the entire central angle.

Additionally, a plurality of sonic signals may be transmitted during the pulse time in different predefined angular segments.

Also, a plurality of sonic signals may be transmitted having different predefined amplitudes and phases.

The downhole tool according to the present invention may further comprise a plurality of second sonic transceivers arranged at a longitudinal distance away from the plurality of sonic transceivers and arranged along the circumference of the tool housing having a mutual distance and being capable of transmitting sonic signals radially away from the tool housing in an entire central angle of 360 degrees towards the borehole wall or borehole.

The present invention also relates to a downhole system comprising:

a wireline, a tool string, a driving unit, a lateral locator, and an operational tool for operating in a lateral, wherein the system further comprises a downhole tool for determining laterals as described above.

The downhole system as described above may further comprise a magnetic profiler.

In another embodiment, the operational tool may be a logging tool, a key tool, a milling tool or a drilling tool.

Said downhole system may further comprise a positioning tool, such as a casing collar locator.

Also, the present invention relates to a method of determining a position of a lateral, comprising the steps of:

- moving the downhole tool to a first position in the borehole,
- conducting a series of pulse/echo measurements comprising:
  - transmitting a sonic signal by a sonic transceiver in a first angular segment during a first pulse time,
  - recording if a reflected sonic signal is received by a sonic transceiver during a first echo time,
  - transmitting a sonic signal by a neighbouring sonic transceiver in a second angular segment during a second pulse time, and
  - recording if a reflected sonic signal is received by a sonic transceiver during a second echo time,
- continuing the series of pulse/echo measurements at the first position until all angular segments along the entire circumference of the tool housing has been investigated using the plurality of sonic transceivers,
- moving the downhole tool to a second position in the borehole,
- conducting a second series of pulse/echo measurements at the second position in the borehole, and
- determining the position of the lateral from the absence of received reflected sonic signals in a subset of the measurements, indicating the position of the lateral.

Said method may further comprise the step of recording a magnetic profile for each recording by the sonic transceiver.

Additionally, the method described above may further comprise the step of performing a plurality of measurements using said method and subsequently combining several recordings by the sonic transceiver having matching recorded magnetic profiles.

The method described above may further comprise the step of inserting an operational tool into the lateral.

Finally, the method as described above may further comprise a step of forcing the downhole tool into the lateral with a lateral locator tool.

BRIEF DESCRIPTION OF THE DRAWINGS

The invention and its many advantages will be described in more detail below with reference to the accompanying schematic drawings, which for the purpose of ILLUSTRATION show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
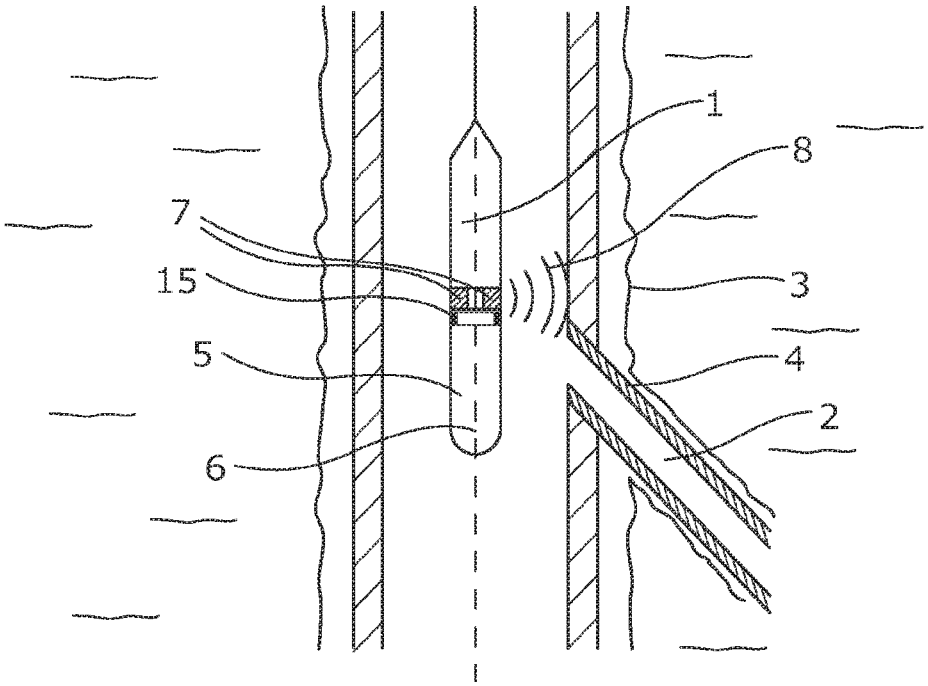
FIG. 1 shows a downhole tool string with a tool for determining laterals.

FIG. 1 shows a downhole tool 1 for determining laterals 2 in a borehole wall 3 in an openhole well or a borehole casing 4 in a cased well. The downhole tool comprises a tool housing 5 extending along a longitudinal axis 6 and a plurality of sonic transceivers 7, each sonic transceiver transmitting sonic signals 8 from the housing 5 towards the borehole wall 3 or the borehole casing 4 and receiving sonic signals 8 reflected from the borehole wall 3 or borehole casing 4. In order to obtain knowledge of the exact position of the downhole tool in the well, a magnetic profiler 15 may be placed next to the sonic transceivers 7. The magnetic profiler 15 is a sensor tool designed to help position the downhole tool. The signal comes from measuring a magnetic field which is distorted by the steel casing. Characteristic spikes or signatures show when the tool passes any significant feature. These characteristics are repeatable and can be used to recognise and compare features, resulting in the provision of knowledge of the exact position of the downhole tool in the well. Simultaneously, the velocity of the tool may be calculated by correlating buffered signals from neighbouring magnetic sensors. The calculated velocities may be combined to a single velocity estimate and then integrated to obtain the position. In some downhole environments, it may be crucial to gain precise knowledge of the position of the downhole tool in order to be able to extract useful information using the sonic transceivers, since several passes of a site of interest may be required to achieve sufficient information from the sonic transceivers which again requires precise knowledge of the position to ensure correlating values of the recordings made by the sonic transceivers. The correlation between magnetic and sonic measurements may be referred to as data fusion between the magnetic and sonic data. Data fusion between signals recorded by the sonic transceivers 7 and the magnetic profiler 15 may be used for alignment of consecutive measurements, thereby minimising errors resulting from differences in a measured depth of the well.

Figure 2:
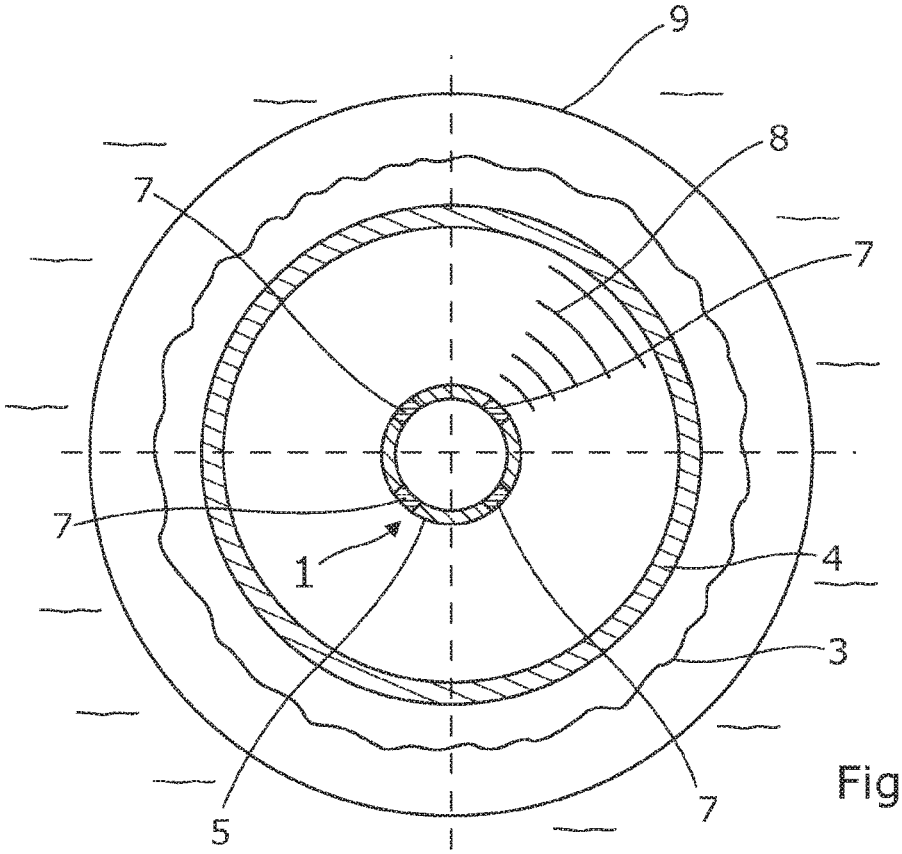
FIG. 2 shows a cross-sectional view of a tool for determining laterals.

FIG. 2 shows how the plurality of sonic transceivers 7 are arranged along the circumference of the tool housing 5 having a mutual distance and are capable of transmitting sonic signals 8 radially away from the tool housing 5 in a predefined angular segment 9 in an entire central angle of 360 degrees towards the borehole wall 3 or borehole casing 4. During use, one transceiver 7 transmits a sonic signal 8 during a pulse time in the predefined angular segment 9 of that sonic transceiver 7, and during a subsequent echo time, one sonic transceiver 7 receives a reflected sonic signal 8 from the borehole wall 3 or borehole casing 4, and an absence of the received reflected sonic signal 8 during the subsequent echo time indicates the lateral 2. This is due to the fact that when there is no casing wall, the signal cannot be reflected and the signal fades.

The sonic transceivers 7 may be arranged equidistantly along the circumference of the tool housing 5 to provide for symmetric measurements of the surrounding borehole wall 3 or borehole casing 4 and divide the annular space between the tool housing and the casing into predefined angular segments 9 of equal size.

To increase the reliability of the measurements, several of the transceivers may be receiving during the echo time to ensure that reflected sonic signals will always be received by at least one of the transceivers. Sonic signals are highly scattered in a downhole environment due to the symmetry of nearby hard surfaces, rough surfaces of the casing or borehole wall and other effects altering the paths of the sonic signals. The reflected signals are therefore received by transceivers located both near by and far away from the transmitting transceiver, e.g. on the other side of the housing. By receiving reflected signals using several transceivers, the redundancy of the system will be improved. Receiving with several transceivers may be done by simultaneous "listening" with several transceivers or by doing a series of measurements in which one transceiver is used to transmit signals and several transceivers are used to receive signals one at a time.

Furthermore, if the physical conditions in the borehole allow, several transceivers may be used simultaneously to transmit signals. Physical conditions which may be appropriate for these types of measurements may be a situation in which the downhole tool 1 fills up nearly the entire annular space in the borehole. Under these conditions, it may be possible to do isolated measurements on several sides of the tool housing without interfering with the other measurements. In this way, measurement time may be drastically decreased, e.g. reduced by half by running two simultaneous series of measurements with transceivers placed diagonally on two sides of the tool housing 5.

Since space is very limited when working downhole and information stream towards the surface is also limited, the computational power needed to conduct useful measurements downhole is normally minimised as much as possible. As both spatial requirements for computational power decreases and the ability to send information to the surface increases, the problem of computational power downhole is becoming less and less problematic. However, the electronic circuits of the transducers in itself represent a problem due to their volume and the related spatial requirements. The use of four to ten transceivers placed equidistantly along the circumference has therefore proven, by experiments, to be sufficient for the determination of laterals without generating too much data, which has to be processed downhole or sent to the surface and furthermore without taking up too much space downhole for electronic circuits of the transducers. Sonic transceivers covering smaller angular segments are placed appropriately to cover the full centre angle of 360 degrees of the borehole.

Due to increasing performances and minimisation of computers as well as due to computational power in general today, arrays of transceivers covering the entire central angle and even being resolved along the longitudinal axis of the tool may prospectively be advantageous if the electronic circuits of the transducers or transducer arrays may be reduced in size and thereby also provide increased resolution in the determination of laterals.

Figure 3A:
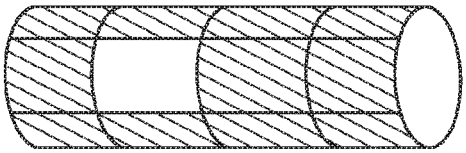
FIG. 3*a* shows graphical representations of the data coming from a tool for determining laterals to visualise the position of a lateral having three different numbers of transceivers with tool.
Figure 3B:
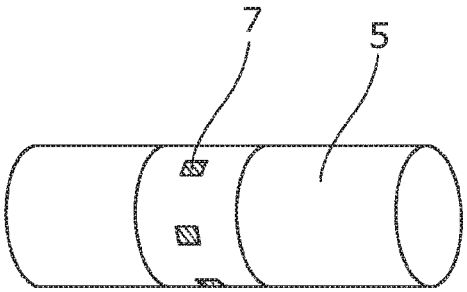
FIG. 3*b* shows a tool corresponding to the graphical representations of the data in FIG. 3*a* having a low number of transmitters.

FIG. 3*a* shows a graphical cylindrical representation of the data coming from a corresponding downhole tool 1 shown in FIG. 3*b* for determining laterals 2 to visualise the position of the lateral 2 for the user. Each square on the cylindrical representation corresponds to one measurement at one given depth in the well. The downhole tool 1 is moved down through the well along the longitudinal axis 6. At a given depth in the well, a series of measurements using the plurality of sonic transceivers 7 are made to investigate the surroundings of the downhole tool at that specific depth. Each of the series of measurements corresponds to one ring of squares on the cylindrical representation.

Figure 3C:
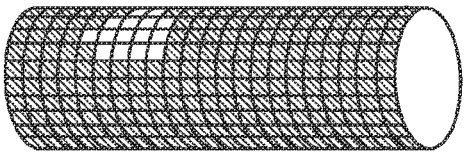
FIG. 3*c* shows graphical representations of the data coming from a tool having more transceivers than the tool of FIG. 3*b*.
Figure 3D:
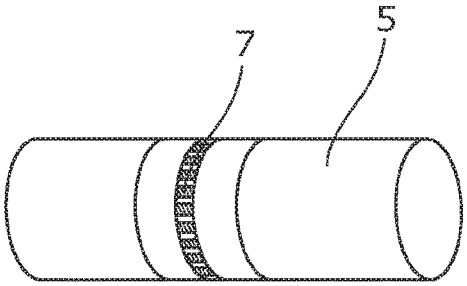
FIG. 3*d* shows a tool corresponding to the graphical representations of the data in FIG. 3*c*.

FIG. 3*c* shows a graphical cylindrical representation of the data coming from a corresponding downhole tool 1 shown in FIG. 3*d*, which is capable of determining laterals 2 with an increased resolution. The increased resolution may be obtained by placing a greater number of sonic transceivers along the circumference of the housing, which increases the resolution by decreasing the resolvable angular segments. Furthermore the resolution may be increased along the longitudinal axis by moving the downhole tool in smaller steps along the longitudinal axis.

Figure 3E:
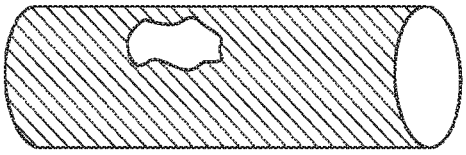
FIG. 3*e* shows graphical representations of the data coming from a tool having more transceivers than the tool of FIG. 3*d*.
Figure 3F:
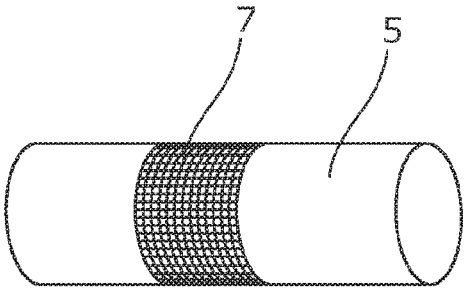
FIG. 3*f* shows a tool corresponding to the graphical representations of the data in FIG. 3*e*.

FIG. 3*e* shows a graphical cylindrical representation of the data coming from a corresponding downhole tool 1 shown in FIG. 3*f*, which is capable of determining laterals 2 with an even higher resolution. The increased resolution may be obtained by arranging arrays of transceivers such as an ultrasonic transducer array along the circumference of the tool housing. The resolution along the longitudinal axis may be equally increased by such arrays if two-dimensional arrays are arranged along the circumference of the tool housing providing resolution in both an angular direction and the longitudinal direction.

Figure 4:
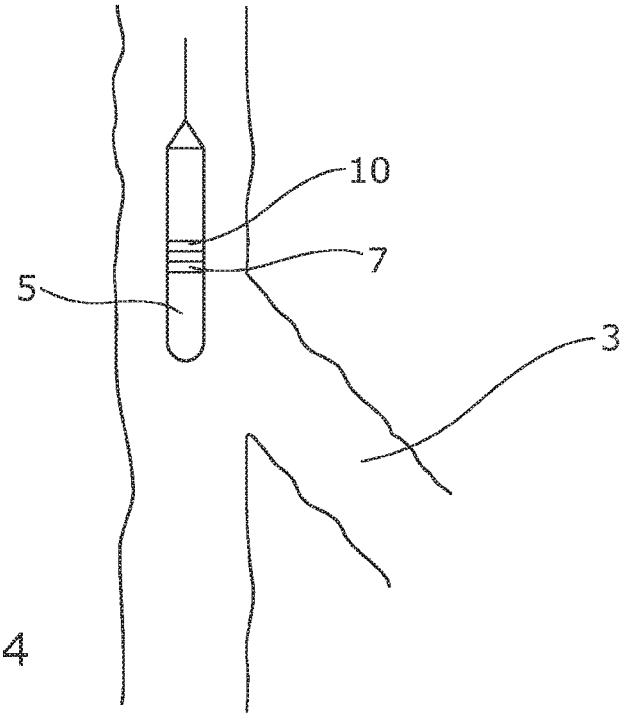
FIG. 4 shows a downhole tool string with a tool for determining laterals comprising a second set of sonic transceivers.

FIG. 4 shows a downhole tool 1 in a borehole wall 3 comprising a lateral 2 without a borehole casing 4. The downhole tool further comprises a second plurality of sonic transceivers 10. Arranging a second plurality of sonic receivers 10 has the advantage of helping the redundancy of the system, such that the tool may still function in case of breakdown of the plurality of sonic transceivers. Furthermore, the second plurality of transceivers may provide a downhole tool 1 capable of determining a lateral faster, since two series of measurements may be made per movement of the downhole tool. Adding even more pluralities of transceivers may further increase the redundancy of the tool, the resolution of a determination of a lateral and/or further increase a speed of the determination of a lateral.

Figure 5:
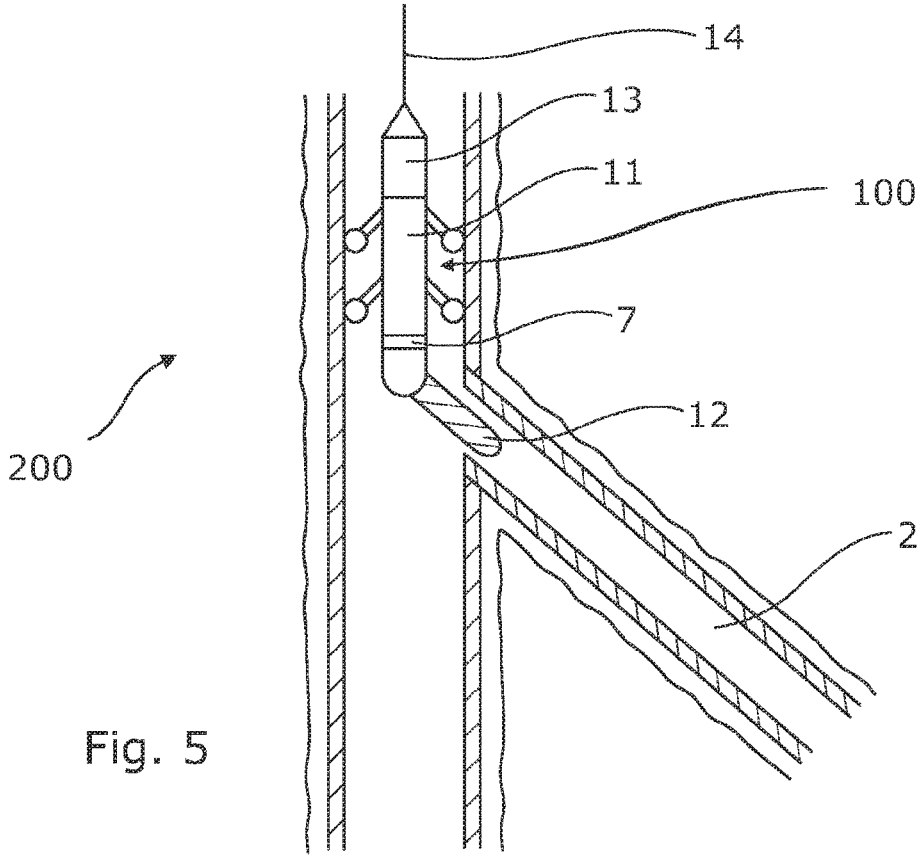
FIG. 5 shows a downhole tool string with a tool for determining laterals comprising a driving unit and a lateral locator tool.

FIG. 5 shows a downhole system 200 for determining laterals comprising a driving unit 11 for conveying the downhole tool 1 along the longitudinal axis deeper into the borehole or retracting the downhole tool 1 by a wireline 14. Furthermore, the downhole tool comprises a lateral locator tool 12 for engaging the lateral 2 after the position of the lateral 2 has been determined by the plurality of sonic transceivers 7. By engaging the lateral 2 with a lateral locator tool 12, the downhole tool 1 may be forced to enter the lateral, thereby allowing any operational tools 13 comprised in the tool to enter the lateral 2 and perform the function of the operational tool 13 in the lateral 2. The operational tool 13 may be a logging tool, a key tool, a milling tool or a drilling tool. The system may further comprise a positioning tool using magnets and magnetometers, such as a casing collar locator.

In a method of determining a position of a lateral according to the invention, the downhole tool 1 is moved to a first position in the borehole for initialising the measurement for determining the position of a lateral 2. At this first position of the downhole tool 1, a series of pulse/echo measurements is conducted, i.e. transmitting a sonic signal referred to as a pulse and receiving the reflected sonic signal referred to as an echo. The pulse signal is initially transmitted by a sonic transceiver in a first angular segment 9 radially away from the downhole tool towards the borehole or borehole casing during a first pulse time. The sonic signal is reflected by the borehole or borehole casing back towards the downhole tool and recorded if the reflected sonic signal is received by a sonic transceiver during a first echo time. If no sonic signal is received during the first echo time, it may indicate that the transceiver is facing the lateral in the borehole, since the transmitted sonic signal will be propagating into the lateral instead of being reflected by the borehole or borehole casing. The lack of reflected signal may also be due to the transceiver not being able to receive the reflected signal, but if this is the case, it is confirmed in the subsequent measurement. If there continues to be no reflected signal in a certain angular segment 9, it indicates that a lateral is present as illustrated in FIG. 3*c*. When the tool is positioned next to a lateral, the transducers facing the lateral have a lower probability of measuring a reflected signal. The probabilities in each direction are different and a probability profile may therefore be used for determining the existence and direction of a lateral. In statistical methods used to derive visible objects, i.e. where the object is directly visible to the observer, the transition probabilities of the object are the only parameters. Statistical methods for uncovering objects not directly visible to the observer, such as a hidden Markov model (HMM), may advantageously be used to derive the existence of a lateral from reflected sonic signals. Since the object is not directly visible when trying to determine laterals, but the output, dependent on the lateral, is visible, i.e. the output near the object, here being a lateral, having a probability distribution over the possible output, statistical models such as the HMM is suitable.

The series of measurements continues in the first position by transmitting a new sonic signal by a neighbouring sonic transceiver in a second angular segment during a subsequent second pulse time, and in the same way the reflected sonic signal is recorded if a sonic transceiver receives the reflected signal during a second echo time. This type of pulse/echo measurements are continued at the first position until all angular segments along the entire circumference of the tool housing have been investigated. Different schemes may be set up for the sequence of pulsing transceivers, transmitting transceivers or receiving transceivers, duration of pulse time, duration of echo time, frequencies, amplitudes etc. To improve redundancy of the method, each of the transceivers receiving the reflected signal may be used to record the reflected signal from one transmitting transceiver by either simultaneously "listening" with all transceivers or "listening" with only one transceiver during the echo time and transmitting a new pulse signal before listening with the next receiver etc. When all angular segments have been investigated, the downhole tool is moved to a second position in the borehole and a second series of pulse/echo measurements is conducted at the second position in the borehole. From the conducted series of measurements, the position of the lateral may be determined from the absence of received reflected sonic signals in a subset of the measurements, since the absence of a reflected signal indicates that the measurement was conducted at a position opposite the position of the lateral.

By placing the downhole tool for determining laterals in a tool string 100 along with other operational tools 13 as mentioned, the tool string 100 may effectively perform tasks in both the borehole wall 3 or main casing and a lateral 2 of the borehole wall 3 or the casing. Furthermore, by using a casing collar locator (CCL) or magnetic profiler, the position of the lateral may be stored in a memory available for the user for future use, which will allow the user to revert to the same lateral faster on subsequent operations.

By the plurality of sonic transceivers being arranged along the circumference of the tool housing, having a mutual distance, and being capable of transmitting sonic signals radially away from the tool housing in an entire central angle of 360 degrees towards the borehole wall or borehole casing is meant that sonic transceivers covering smaller angular segments are placed appropriately along the circumference of the tool. The sonic transceivers thus cover the full centre angle of 360 degrees of the borehole when transmitting and receiving signals.

Although the invention has been described in the above in connection with preferred embodiments of the invention, it will be evident for a person skilled in the art that several modifications are conceivable without departing from the invention as defined by the following claims.

The invention claimed is:

1. A downhole tool for determining laterals in a borehole wall or a borehole casing, comprising:

a tool housing extending along a longitudinal axis and having a circumference perpendicular to the longitudinal axis and adapted to be lowered into a well, a plurality of sonic transceivers, each sonic transceiver configured to transmit sonic signals from the tool housing and to receive sonic signals reflected from the borehole wall or borehole casing in a predefined angular segment that is different from the predefined angular segments corresponding to the other sonic transceivers of the plurality of sonic transceivers, wherein the plurality of sonic transceivers are arranged along the circumference of the tool housing having a mutual distance and are configured to transmit sonic signals radially away from the tool housing in an entire central angle of 360 degrees towards the borehole wall or borehole casing, wherein the plurality of sonic transceivers are configured such that, during use, only one first sonic transceiver of the plurality of sonic transceivers transmits, during a first pulse time, sonic signals, and each of the plurality of sonic transceivers receives, during a pre-set first echo time period subsequent to the first pulse time, the reflected sonic signals from the borehole wall or borehole casing, wherein the plurality of sonic transceivers are further configured such that only one second sonic transceiver of the plurality of sonic transceivers directly neighbouring the first sonic transceiver along the circumference of the tool housing transmits, during a second pulse time subsequent to the pre-set first echo time period, sonic signals and each of the plurality of sonic transceivers receives, during a pre-set second echo time period subsequent to the second pulse time, the reflected sonic signals from the borehole wall or borehole casing, and wherein an absence of the received reflected sonic signal, during the pre-set first echo time period or the pre-set second echo time period, indicates a lateral, and wherein the plurality of sonic transceivers are further configured to continue series of pulse and echo measurements until all angular segments along the entire circumference of the tool housing have been investigated sequentially using a sonic transceiver directly neighbouring, along the circumference of the tool housing, a previously used sonic transceiver of the plurality of sonic transceivers and a magnetic profiler configured to measure a magnetic profile of the borehole casing and wherein the magnetic profiler is configured to apply a magnetic field and measure a change in the magnetic field for alignment of consecutive measurements of downhole tool base on correlation between the measured magnetic field and signals recorded by the plurality of sonic transceivers.

2. A downhole tool according to claim 1, wherein the change in the magnetic field is measured as a function of an interaction between the borehole casing and the magnetic field.

3. A downhole tool according to claim 1, wherein the sonic transceivers are arranged equidistantly along the circumference of the tool housing, having a fixed mutual distance.

4. A downhole tool according to claim 1, wherein the sonic transceivers are arranged along the circumference of the tool housing in a regular pattern.

5. A downhole tool according to claim 1 wherein the downhole tool comprises at least four sonic transceivers, with each transceiver configured to transmit sonic signals covering at least one forth of the entire central angle.

6. A downhole tool according to claim 1, wherein the downhole tool comprises an array of sonic transceivers arranged on a common plane along the circumference of the tool housing and configured to transmit sonic signals covering the entire central angle.

7. A downhole tool according to claim 1, wherein the sonic transceivers are configured to transmit sonic signals having different predefined amplitudes and phases.

8. A downhole tool according to claim 1, further comprising a plurality of second sonic transceivers arranged at a longitudinal distance away from the plurality of sonic transceivers and arranged along the circumference of the tool housing having a mutual distance and being configured to transmit sonic signals radially away from the tool housing in an entire central angle of 360 degrees towards the borehole wall or borehole.

9. A method of determining a position of a lateral in a borehole wall or a borehole casing using a downhole tool comprising (1) a tool housing extending along a longitudinal axis and having a circumference perpendicular to the longitudinal axis and adapted to be lowered into a well, (2) a plurality of sonic transceivers arranged along the circumference of the tool housing having a mutual distance and configured to transmit sonic signals radially away from the tool housing in an entire central angle of 360 degrees towards the borehole wall or borehole casing, each sonic transceiver configured to transmit sonic signals from the tool housing and to receive sonic signals reflected from the borehole wall or borehole casing in a predefined angular segment that is different from the predefined angular segments corresponding to the other sonic transceivers of the plurality of sonic transceivers, and (3) a magnetic profiler configured to measure a magnetic profile of the borehole casing, the method comprising:

moving the downhole tool in the borehole;

conducting a series of pulse and echo measurements comprising:

transmitting a sonic signal in a first angular segment by only one first sonic transceiver of the plurality of sonic transceivers during a first pulse time, receiving reflected sonic signals by each of the plurality of sonic transceivers during a pre-set first echo time period subsequent to the first pulse time, transmitting a sonic signal in a second angular segment by only one second sonic transceiver of the plurality of sonic transceivers directly neighbouring, along the circumference of the tool housing, the first sonic transceiver during a second pulse time subsequent to the pre-set first echo time period, receiving reflected sonic signals by each of the plurality of sonic transceivers during a pre-set second echo time period subsequent to the second pulse time, and continuing the series of pulse and echo measurements until all angular segments along the entire circumference of the tool housing has been investigated sequentially using a sonic transceiver directly neighbouring, along the circumference of the tool housing, a previously used sonic transceiver of the plurality of sonic transceivers;

applying a magnetic field and measure a change in the magnetic field using the magnetic profiler;

aligning consecutive measurements of downhole tool based on correlation between the measured magnetic field and signals recorded by the plurality of sonic transceivers; and determining the position of the lateral from an absence of received reflected sonic signals in the pre-set first echo time period or the pre-set second echo time period, indicating the position of the lateral.

10. A method according to claim 9, further comprising recording a magnetic profile for each transceiver based on the received reflected sonic signals by the sonic transceivers and combining a plurality of recordings by the sonic transceivers having matching recorded magnetic profiles.

11. A method according to claim 9, further comprising the step of inserting an operational tool into the lateral.

12. A method according to claim 9, further comprising a step of forcing the downhole tool into the lateral with a lateral locator tool.

* * * * *